US010827886B2

(12) United States Patent
Bullock

(10) Patent No.: US 10,827,886 B2
(45) Date of Patent: Nov. 10, 2020

(54) BODY DRYING DEVICE

(71) Applicant: Alisha Bullock, Henderson, CO (US)

(72) Inventor: Alisha Bullock, Henderson, CO (US)

( * ) Notice: Subject to any disclaimer, the term of this patent is extended or adjusted under 35 U.S.C. 154(b) by 169 days.

(21) Appl. No.: 15/685,295

(22) Filed: Aug. 24, 2017

(65) Prior Publication Data

US 2018/0064298 A1 Mar. 8, 2018

Related U.S. Application Data

(60) Provisional application No. 62/382,890, filed on Sep. 2, 2016.

(51) Int. Cl.
*F26B 25/10* (2006.01)
*A47K 10/48* (2006.01)

(52) U.S. Cl.
CPC ..... *A47K 10/48* (2013.01)

(58) Field of Classification Search
CPC ..... A47K 10/48
See application file for complete search history.

(56) References Cited

U.S. PATENT DOCUMENTS 2,471,008 A * 5/1949 Pretty ..... A47K 3/002 15/215
4,780,595 A 10/1988 Alban
4,961,272 A * 10/1990 Lee ..... A47K 10/48 34/202
6,148,539 A 11/2000 Hatfield et al.
6,349,484 B1 2/2002 Cohen
8,112,899 B1 2/2012 Duckworth
2005/0086735 A1 4/2005 Lim
2008/0060119 A1* 3/2008 Pinizzotto ..... A47K 13/302 4/217
2010/0050462 A1* 3/2010 Attonito ..... A47K 10/48 34/201
2010/0126978 A1* 5/2010 Semmes ..... F24D 13/022 219/217
2011/0186137 A1* 8/2011 Hanna ..... E03C 1/05 137/1
2013/0025149 A1* 1/2013 Farousi ..... A47K 10/48 34/88
2016/0000273 A1* 1/2016 Shah ..... A47K 3/28 4/601

* cited by examiner

*Primary Examiner* — Jason Lau
(74) *Attorney, Agent, or Firm* — Boudwin Intellectual Property; Daniel Boudwin

(57) ABSTRACT

A sensored body drying device for minimal or towel-free drying. The body drying device includes an upright housing with a base orthogonally connected on the bottom thereof, wherein a plurality of nozzles disposed along the upright housing expel air therethrough to dry a user standing on the base. An air blowing source is operably connected to the nozzles and a control panel, wherein the control panel includes a display screen disposed on the upright housing wherein a user can regulate settings, such as air flow and temperature. A heating element is operably connected to the air blowing source in order to heat the air expelled through the nozzles for a more efficient drying process. A sensor disposed along a bottom end of the upright housing can detect a user standing on the base and send a signal to the control panel to automatically initiate the air blowing device.

1 Claim, 4 Drawing Sheets

BODY DRYING DEVICE

CROSS REFERENCE TO RELATED APPLICATIONS

This application claims the benefit of U.S. Provisional Application No. 62/382,890 filed on Sep. 2, 2016. The above identified patent application is herein incorporated by reference in its entirety to provide continuity of disclosure.

BACKGROUND OF THE INVENTION

The present invention relates to a sensored body drying device. More specifically, the present invention provides an upstanding housing having a plurality of nozzles configured to dispense air to a user positioned on a base and collect the excess water using a drain.

Facilities such as hotels, schools, fitness centers, military bases and pool centers have shower facilities that are offered to guests and patrons. These facilities often also provide towels for those who use the showers. As a result, the facilities have to purchase large amounts of towels at great expense to accommodate guests and patrons. These towels are often lost, stolen or in need of replacement which further adds to the expense. Further, washing the towels also uses a great deal of water and is a time-consuming process. Unfortunately, there are some individuals that do not like using towels provided by facilities for personal reasons and sanitary concern. Further, some individuals prefer to air or blow dry for a benefit to their skin from reduced irritation and dry patches.

In light of the devices disclosed in the known art, it is submitted that the present invention substantially diverges in design elements from the known art and consequently it is clear that there is a need in the art for an improvement to existing body drying devices. In this regard, the instant invention substantially fulfills these needs.

SUMMARY OF THE INVENTION

In view of the foregoing disadvantages inherent in the known types of body drying devices now present in the prior art, the present invention provides a sensored body drying device wherein the same can be utilized for providing convenience for the user when drying off after using a shower or pool with minimal or no need for using a towel.

It is therefore an object of the present invention to provide a new body drying device that has all of the advantages of the prior art and none of the disadvantages.

It is another object of the present invention to provide a body drying device comprising an upright housing with a base orthogonally connected to an edge thereon, having a plurality of nozzles disposed along the upright housing wherein the nozzles are operably connected to an air blowing device which expels air therethrough.

Another object of the present invention is to provide a body drying device wherein a sensor is located within the device and configured to detect when a user is present.

It is another object of the present invention to provide a body drying device wherein a heating element is operably attached to the compressor and control panel and configured to heat the air being expelled through the plurality of nozzles disposed along the upright housing.

It is another object of the present invention to provide a body drying device wherein a display screen for the control panel is located on the upright housing and utilizes actuators or touch responsive controls.

It is yet another object of the present invention to provide a body drying device wherein the base of the device has a padded, water-resistant top surface.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
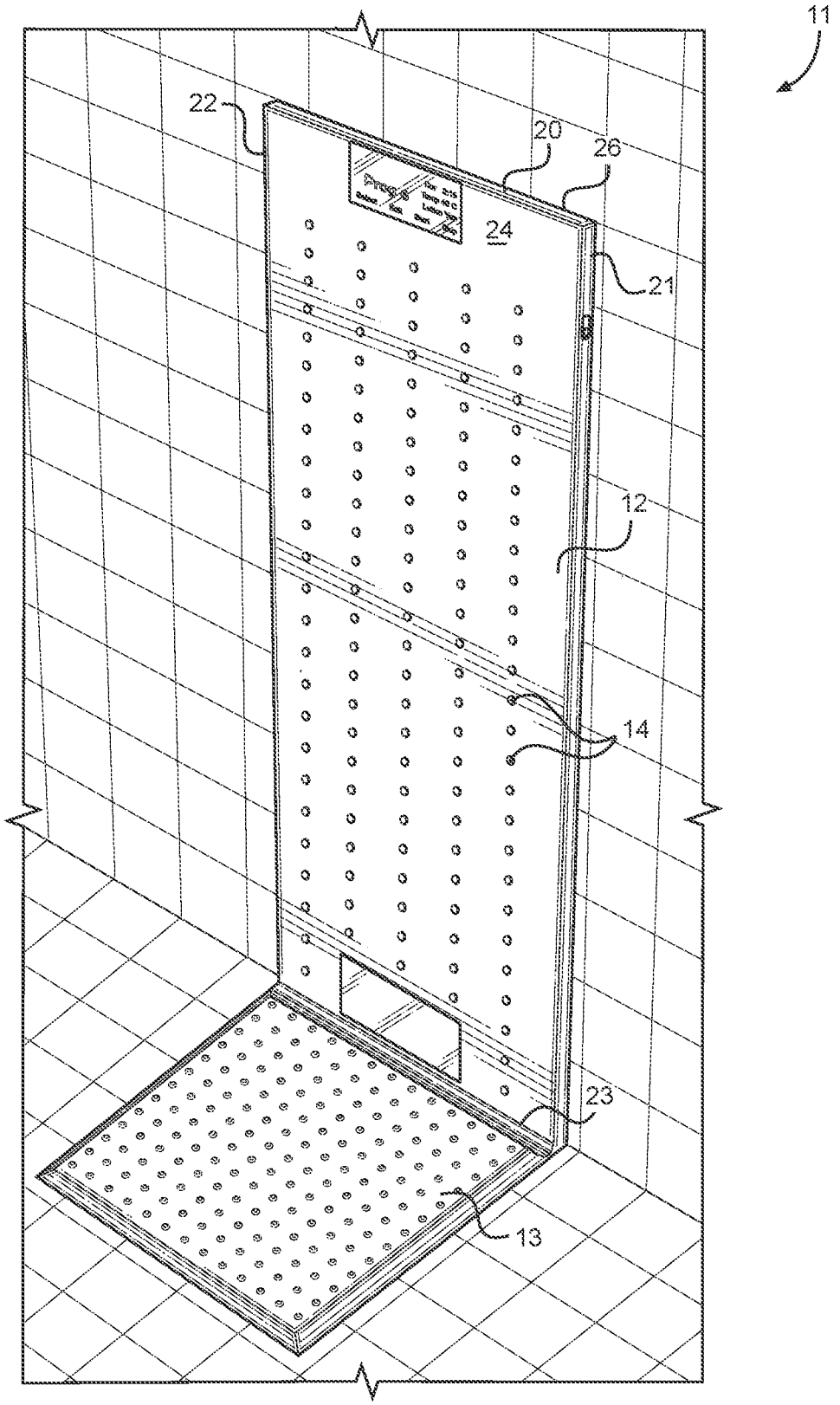
FIG. 1 shows a side perspective view of an embodiment of the sensored body drying device.

Reference is made herein to the attached drawings. Like reference numerals are used throughout the drawings to depict like or similar elements of the sensored body drying device. For the purposes of presenting a brief and clear description of the present invention, the preferred embodiment will be discussed as used for drying the body while standing in an upright position within the device. The figures are intended for representative purposes only and should not be considered to be limiting in any respect.

Referring now to FIG. 1, there is shown a side perspective view of an embodiment of the body drying device. The body drying device 11 comprises an upright housing 12 having a base 13 connected to an edge thereon, wherein a plurality of nozzles 14 disposed along the upright housing 12 are operably connected to an air blowing source and configured to expel air therethrough.

In the illustrated embodiment, the upright housing 12 comprises a substantially rectangular shape having a top edge 20, two opposing sides 21, 22 and a bottom edge 23. The base 13 is orthogonally attached to the bottom edge 23 of the upright housing 12. In the illustrated embodiment, the upright housing 12 is planar, having a front surface 24 and a back surface 25, wherein the front surface 24 faces towards the base 13 and the back surface 25 is configured to rest flush against a wall. In one embodiment, the back surface 25 is attached to the wall via adhesive materials such as glue or caulk. In alternate embodiments, the back surface 25 of the housing 12 is connected to the wall via fasteners, such as screws.

The plurality of nozzles 14 disposed along the front surface 24 of the upright housing 12 are configured to expel air therethrough toward a user standing on the base 13 of the body drying device 11. In the illustrated embodiment, the nozzles 14 are disposed along the housing 12 in equally spaced horizontal and vertical displacement from one another. The nozzles 14 are located within apertures in the front facing surface 24 of the housing 12 and have openings that direct the flow of air in a specific pattern toward the user standing on the base 13 of the body drying device 11.

Figure 2:
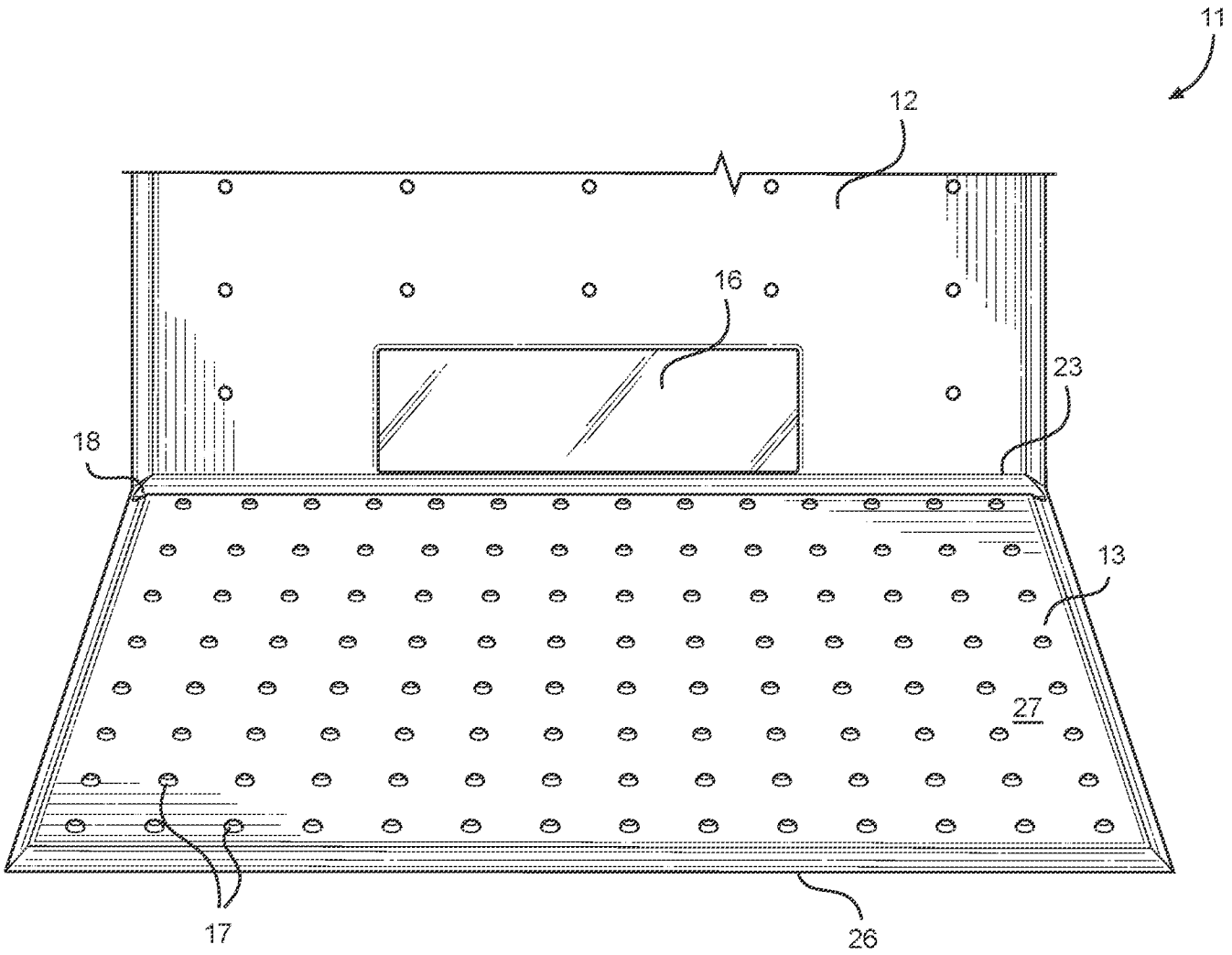
FIG. 2 shows a front view of the base and sensor of an embodiment of the sensored body drying device.

Referring now to FIG. 2, there is shown a front view of the base and sensor of an embodiment of the body drying device. In the illustrated embodiment, the base 13 comprises a substantially rectangular shape having a bottom surface 26 that is adapted to rest flush with a floor and a top surface 27 for a user to stand on, wherein one side of the base 13 is orthogonally connected to the bottom edge 23 of the upright housing 12. In the illustrated embodiment, the top surface 27 of the base 13 comprises a padded, water-resistant material whereon a plurality of semi-circular protrusions 17 extend from the top surface 27 to provide slip protection for a user.

In the illustrated embodiment, a drainage channel 18 is disposed along the base 13 adjacent to the region where the base 13 joins the bottom edge of the housing 12. The drainage channel 18 allows for excess liquid and moisture to be collected therein and removed from the base 13 via a pair of open ends of the drainage channel 18. The open ends of the drainage channel align with the outer perimeter of the base 13. The outer perimeter of the base 13 tapers down from the top surface 27 towards bottom surface 26 to allow for a slope onto the base 13. In this way, a user can avoid tripping over the perimeter of the base 13.

A sensor 16 is located near the bottom edge of the upright housing 12 and configured to detect a user when standing on the base 13 of the sensored body drying device 11. In the illustrated embodiment, the sensor 16 is configured to detect motion. In alternate embodiments of the body drying device 11, the sensor 16 may be configured to detect additional weight on the base 13. The sensor 16 is operably connected to a control panel and is configured to send a signal to the control panel such that the sensored body drying device 11 is automatically activated.

Figure 3:
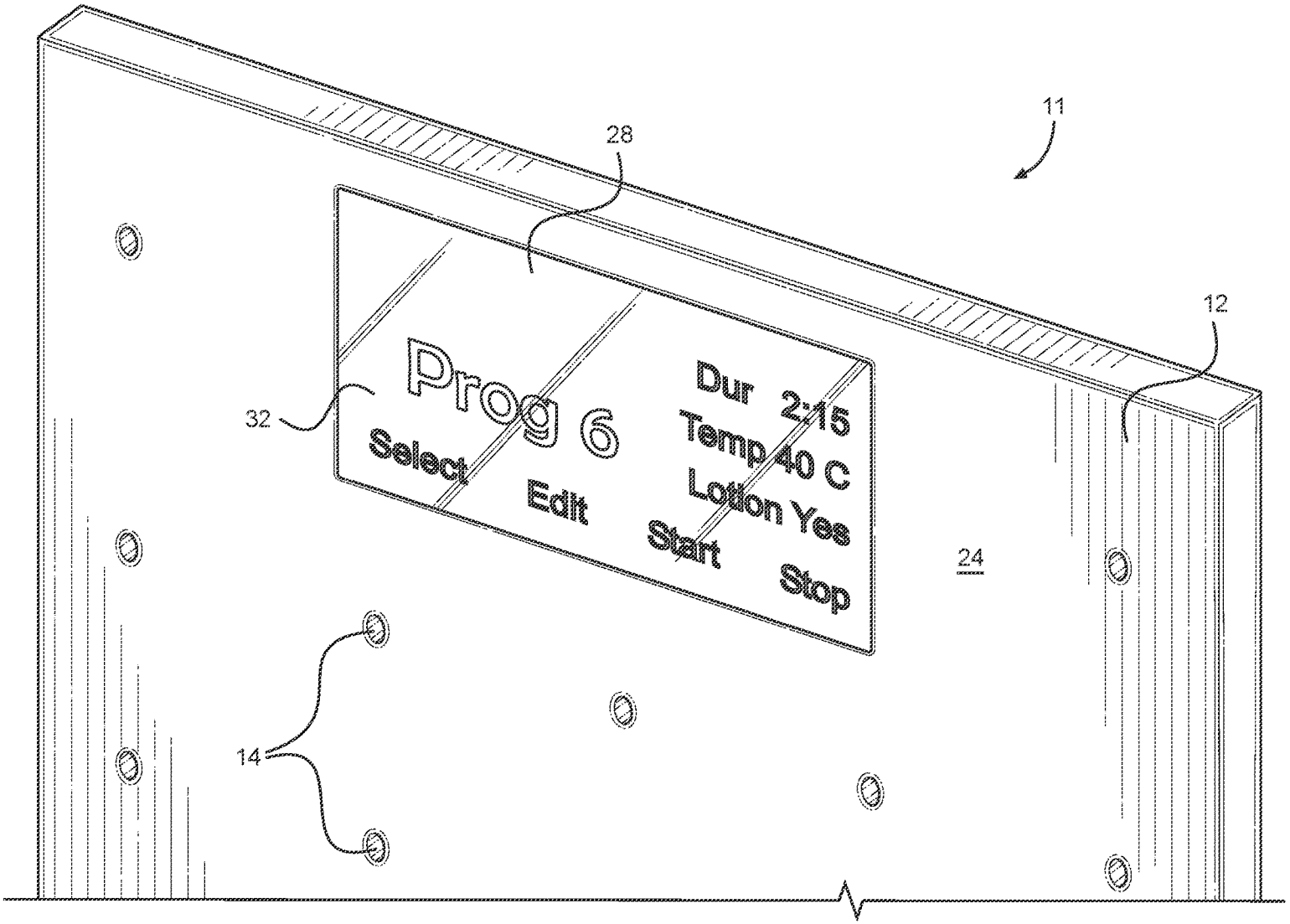
FIG. 3 shows a perspective view of the housing and display screen of an embodiment of the sensored body drying device.
Figure 4:
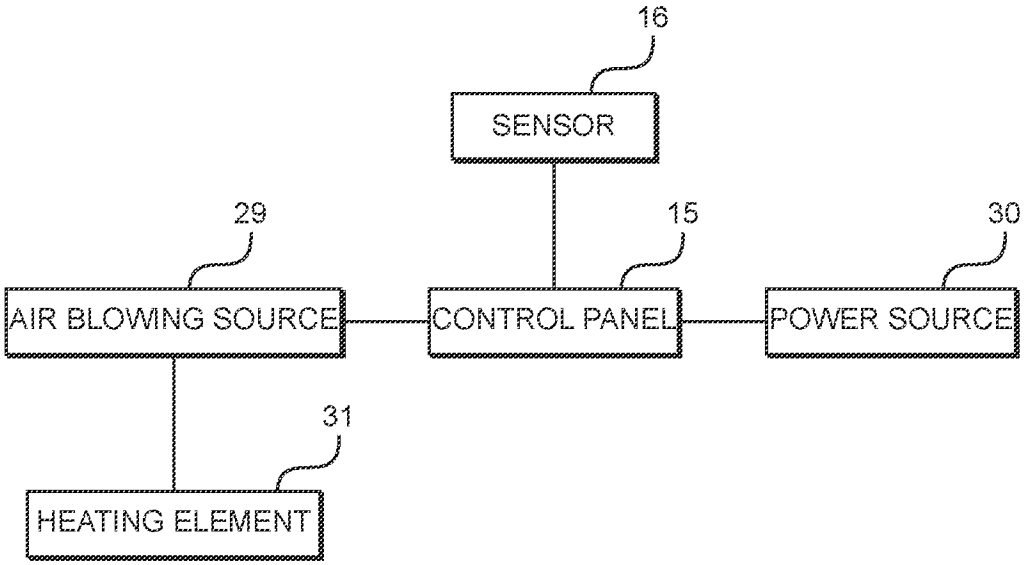
FIG. 4 shows a diagram of the control circuit of the electrical components of an embodiment of the sensored body drying device.

Referring now to FIGS. 3 and 4, there is shown a perspective view of the housing and display screen of an embodiment of the body drying device and a diagram of the control circuit of the electrical components of an embodiment of the body drying device, respectively. A control panel 15 is located on the front facing surface 24 of the upright housing 12 and is operably connected to a power source 30. The control panel 15 comprises a display screen 28 wherein actuators or touch responsive screens 32 allow a user to control several different settings for the sensored body drying device 11, such as temperature and air flow.

In the illustrated embodiment, the body drying device 11 can be set to automatically turn on when the sensor 16 detects a user standing within the device. Actuators or touch responsive screens 32 can also allow a user to select a drying program or edit the duration of air flow for a given each cycle as well as manually starting and stopping the device. In an alternate embodiment of the body drying device 11, users would be able to select an option on the control panel 15 for fluid, such as lotion, to be sprayed through select nozzles 14. The fluid being held in removably attachable reservoirs within the housing 12 and operable connected to the nozzles 14.

The control panel 15 regulates the flow from the air blowing source 29. In the illustrated embodiment, the air blowing source 29 is a compressor. A heating element 31 is operably attached to the compressor and control panel 15 wherein the heating element 31 is adapted to raise the temperature of the air from the compressor to be expelled through the plurality of nozzles 14 for more effective drying capabilities.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body drying device consisting of:

an upright housing having a back surface configured to rest flush against a wall and a front surface configured to face outward from the wall;

a base, wherein an edge of the base is orthogonally connected to an end of the upright housing;

a plurality of nozzles disposed along the front surface of the upright housing and operably connected to an air blowing source disposed within the upright housing;

a control panel disposed in the upright housing and operably connected to a power source, wherein the control panel regulates air flow from the air blowing source to nozzles of the plurality of nozzles;

a sensor disposed on the upright housing and operably connected to the control panel, wherein the sensor is configured to detect when a user is standing on the base;

wherein the base comprises a downwardly sloped outer perimeter that connects a top surface of the base to the floor.

* * * * *